United States Patent [19]

Leach

[11] Patent Number: 5,029,414

[45] Date of Patent: Jul. 9, 1991

[54] SERVING WINDOW

[76] Inventor: Richard M. Leach, Rte. 2, P.O. Box 26, Willard, Mo. 65781

[21] Appl. No.: 526,121

[22] Filed: May 21, 1990

[51] Int. Cl.[5] ..... E05F 17/00

[52] U.S. Cl. ..... 49/122; 49/356

[58] Field of Search ..... 49/122, 116, 101, 109, 49/110, 111, 356, 357

[56] References Cited

U.S. PATENT DOCUMENTS

| | | | |
|---|---|---|---|
| 1,249,220 | 12/1917 | Simpson | 49/111 |
| 4,702,037 | 10/1987 | Hollowell et al. | 49/356 X |
| 4,862,639 | 9/1989 | Leach et al. | 49/122 |

*Primary Examiner*—Philip C. Kannan

*Attorney, Agent, or Firm*—Polster, Polster and Lucchesi

[57] ABSTRACT

In a serving window having a pair of center-opening swinging window members of the type illustrated and described in U.S. Pat. No. 4,862,639, a crank pin, extending downwardly from the crank arm of each window member, extends into a channel carried by an elongated bar extending between the crank pins. The bar is pivoted asymmetrically and is rocked about its pivot point by an operator shaft positioned substantially midway between the window members. A link is pivoted at one end to the operator shaft and at its other end, to the bar adjacent one end thereof.

8 Claims, 2 Drawing Sheets

SERVING WINDOW

BACKGROUND OF THE INVENTION

This invention is an improvement on the serving window of Leach and Miles U.S. Pat. No. 4,862,639, issued Sept. 5, 1989. The device of that patent is commercially successful and works well. However, it has at least one disadvantage in that a push/pull rod 32 of that device is located near one end of the counter, so that pressure on a bump bar 34 is most effective at one end of the bar.

One of the objects of this invention is to provide a serving window operable from the center of the span between window members.

Another object of this invention is to provide a serving window with an operating mechanism that is simple, rugged and dependable.

Other objects will be apparent to those skilled in the art in light of the following description and accompanying drawings.

SUMMARY OF THE INVENTION

In accordance with this invention, generally stated, a serving window has a pair of center opening swinging window members, each mounted on a vertical shaft projecting downwardly from its respective window member, a frame receiving the window members, the frame including a sill housing beneath the window members into which the shafts extend, and an operating mechanism in the housing for opening and closing the window members. The operating mechanism includes a crank arm secured to each of the shafts and a crank pin extending downwardly from each of the crank arms. An elongated operating bar extends between the crank pins, mounted intermediate its ends on pivot means and carrying channel means into which the crank pins extend. Operator means are provided substantially midway between the outer edges of the window members along the sill housing, for rocking the bar about the pivot means to rotate the crank arms between window opened and window closed positions. Preferably the operator means includes a shaft mounted to move substantially perpendicularly to the plane of the window members in their closed position, and a link pivoted to the shaft at one end and at another end to the operating bar. The top wall of the sill housing is stepped to form a ledge against which a lip along the bottom outer edge of the window members can abut.

DESCRIPTION OF THE PREFERRED EMBODIMENT

Figure 1:
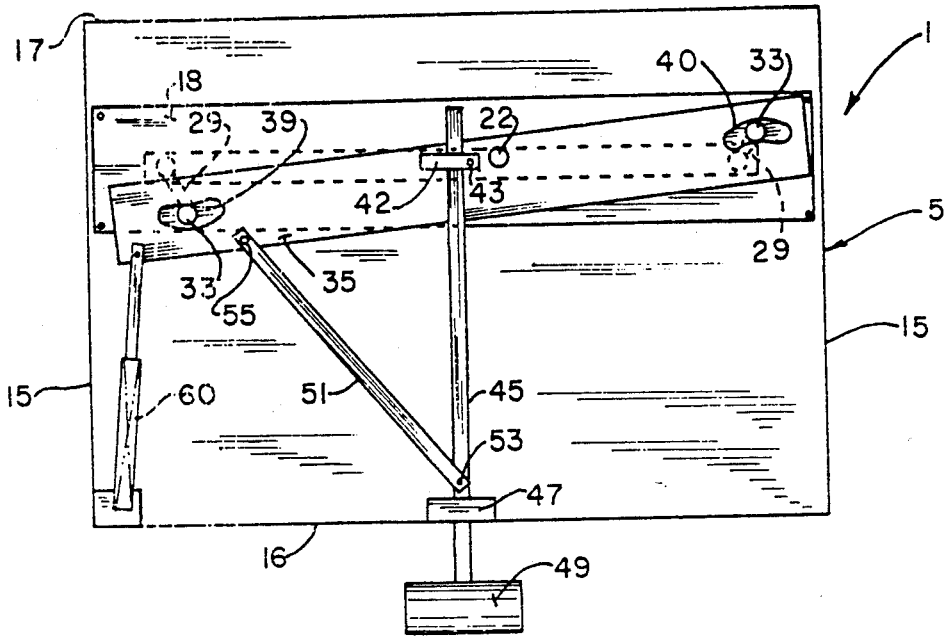
FIG. 1 is a bottom plan view of one embodiment of operating mechanism of this invention.

Referring now to the FIG. 1, reference numeral 1 indicates one illustrative embodiment of serving window of this invention. The serving window 1 includes swinging window members 2 and 3, mounted in a frame 4. The frame 4 includes a sill housing 5.

Figure 3:
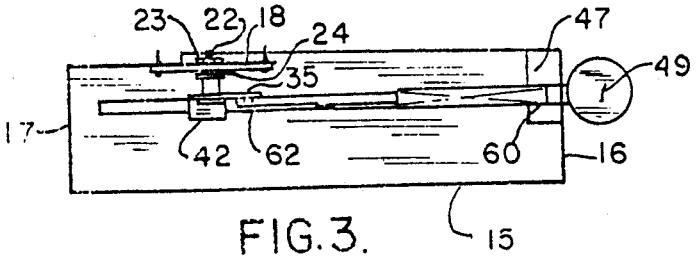
FIG. 3 is a cut-away view in end elevation viewed from left to right in FIGS. 1 and 2.
Figure 4:
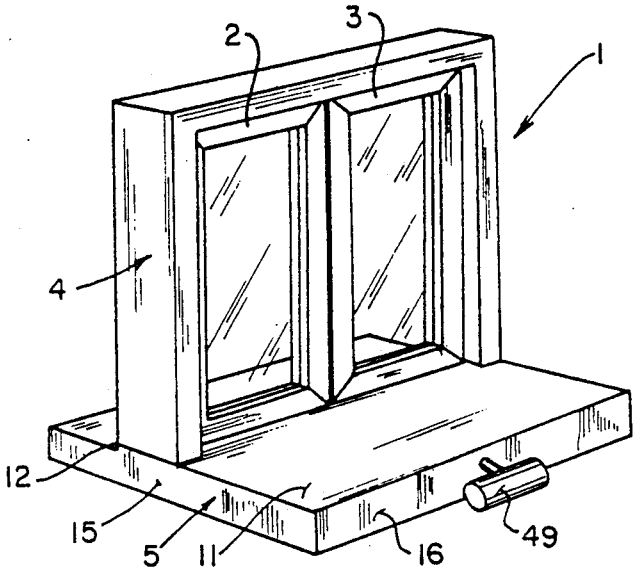
FIG. 4 is a view in perspective of a serving window of this invention.
Figure 5:
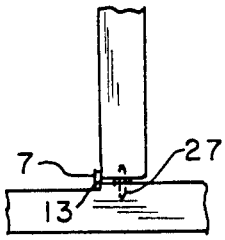
FIG. 5 is a fragmentary view in side elevation of a portion of the sill housing and window.

The sill housing 5 is essentially an open bottomed box, with a top wall 11, side walls 15, front or inner wall 16 and rear or outer wall 17. The top wall 11 is, in this illustrative embodiment, provided with a step 12, which forms a ledge 13 against which a lip 7 along each of the swinging window members 2 and 3 abuts. It also provides, on the inside of the housing 5, head room between the under side of the top wall 11 and a mounting plate 18. The plate 18, which can be made of heavy aluminum, is mounted by means of screws 20, extending through the top wall 11 and into interior frame members, not here shown, serving the double purpose of mounting the plate 18 and joining the jamb posts of the frame 4 to the sill housing. Depending upon the construction of the jamb posts, the mounting plate 18 may be bolted to them. As can be seen from FIG. 3, the step in the top wall provides head space between a portion of the plate and the undersurface of the sill top. An axle bolt 22, with a head 23 and a shank 24, extends through a hole in the mounting plate 18, with the head 23 in the head space, and is held, in this embodiment, with a lock nut run up tightly against the inside surface of the mounting plate.

Each of the window members 2 and 3 has a pivot pin 27 extending downwardly near its outboard edge, through holes in the top 11 and mounting plate 18. The pins 27 carry at their lower ends cranks 29 from the free end of which crank pins 33 depend.

Figure 2:
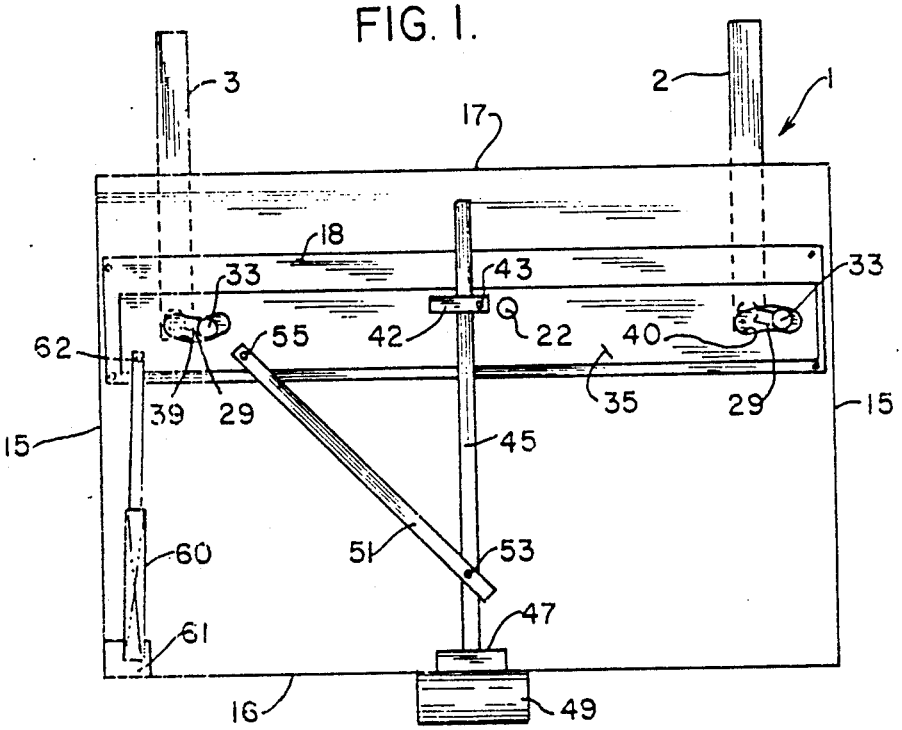
FIG. 2 is a bottom plan view of the operating mechanism in a position in which window members are swung to their opened position.

An operating bar 35, in this embodiment, in the form of a steel plate, is pivotally mounted on the axle bolt 22. The operating bar 35 is rectangular in plan, as illustrated in FIGS. 1 and 2. The bar is pivoted at a point that is asymmetrical with respect to both the longitudinal and transverse center lines of the bar. The bar 35 has channel members into which the crank pins 33 extend. In this embodiment, the channel members take the form of arcuate slots 39 and 40 through the bar, through which the crank pins extend. The slots 39 and 40 are oppositely oriented with respect to the longitudinal center line of the bar 35, as seen clearly in FIGS. 1 and 2.

A guide block 42 is mounted on the lower surface of the operating bar 35 by means of a retainer bolt 43 which is mounted at its upper end in the bar 35 in such a way as to permit movement of the guide block 42 about the retainer bolt. The guide block 42 has a passage running transversely through it, the axis of which is substantially along the transverse center line of the operating bar 35, which is equidistance from the outer edges of the window members 2 and 3, and also from the side walls 15 of the sill housing An operator shaft 45 extends at its distal end with respect to the front wall 16, through the passage in the guide block 42, and at its proximal end, through a bearing block 47 and beyond the front wall 16. The bearing block 47 is mounted on the front wall 16 and is provided with a passage through which the operator shaft 45 passes slidably but closely as compared with the passage through the guide block 42 which is sufficiently oversized with respect to the diameter of the shaft 45 to permit relative movement of the guide block 42 and the shaft 45, through a very small arc. The operator shaft 45 carries at its outer end, a bump roll 49, by which a person can move the operator shaft 45 from the position shown in FIG. 1 to the position shown in FIG. 2.

An operating lever 51 is pivoted at 53, at one end, to the operating shaft 45, and at its other end, on a pivot 55, to the bar 35.

A return mechanism 60, which can take the form of a cylinder and piston, either provided with an internal spring or a pneumatic actuator, is pivotally mounted on a mounting bracket 61 attached to the sill housing at one end, and to the operating bar 35 by a pivot pin 62, at its other end. When the operating shaft is not pushed in against the bias of the spring, the spring keeps the operating bar in the position shown in FIG. 1, in which the window members 2 and 3 are closed.

Merely by way of illustration, in a serving window in which the sill housing 5 is rectangular in plan, the distance between the side walls 15 being approximately twenty-four inches and the distance between the front wall 16 and the rear wall 17 approximately twenty inches, the distance from the rear wall 17 to the step 12 being five inches, and from the ledge 13 to the front wall 16, about fifteen inches, the jamb members of the frame being approximately three quarters by four inches, and the step ledge being approximately a quarter inch high, the mounting plate 18, made of quarter inch aluminum, can be approximately four inches wide and as long as the distance between the inner surfaces of the side walls 15 permits. The operating bar 35 can be a steel plate three sixteenth inch thick, two and a half inches wide and twenty-one and a half inches long. The distance of the center of the pin 22 from the rear edge of the bar can be approximately one and one sixteenth inches. The passage through the operating bar is of a size to admit a bushed axle shaft 24 three eighths inch in diameter, and the distance to the center of the passage from the right edge of the operating bar as viewed in FIGS. 1 and 2 is on the order of ten and five sixteenth inches.

The guide block 42 can be a block of nylon two inches long, one inch high, and a half inch thick. The passage through the guide block through which the operator shaft 45, when the operator shaft 45 is a cylindrical rod half an inch in diameter, can be eighteen thirty seconds, while the diameter of the passage through the bearing block 47 is preferably on the order of thirty-three sixty-fourths. The bearing block 47 can also be of nylon, and is preferably somewhat thicker, as for example, one inch, to provide more bearing surface. The retainer bolt 43 can be a 632 machine screw two inches long, with a nut held in place by Locktite or the like to permit the block 42 to move about the retainer bolt. The movement need be slight, because the travel of the operating bar 35 at its outer ends is only in the neighborhood of two to two and one half inches. The slot 39 in this illustrative embodiment can be five eighths of an inch wide and an inch and three quarters long, and the slot 40, also five eighths of an inch wide, two and one eighths inches long. The configuration and position of the of the slots will depend upon the length of the crank arms 29. The crank pin 33 can be quarter inch/20 stud, surrounded by a nylon bearing sleeve, retained by a locknut and washer that can also serve to retain the operating bar.

The operating lever 51 can be made of one quarter by one half inch steel, and can take the form of an angle or channel iron to add rigidity to the lever, if desired.

As will be apparent from FIGS. 1 and 2, when the bump roll 49 is pushed toward the wall 16 of the sill housing, the lever 51 rocks the operating bar about the pivot 22, causing the crank pins 33 to engage a concave surface of the slot in which it rides, rotating the crank arm from which the pin extends, hence the window member pivot pin, which is secured to the window member to rotate the window members to the position shown in FIG. 2. When pressure on the bump roll 49 is released, the spring mechanism 60 restores the assembly to the condition shown in FIG. 1, the crank pins engaging the convex surface of the slot to rotate the crank arms to their initial position.

Figure 6:
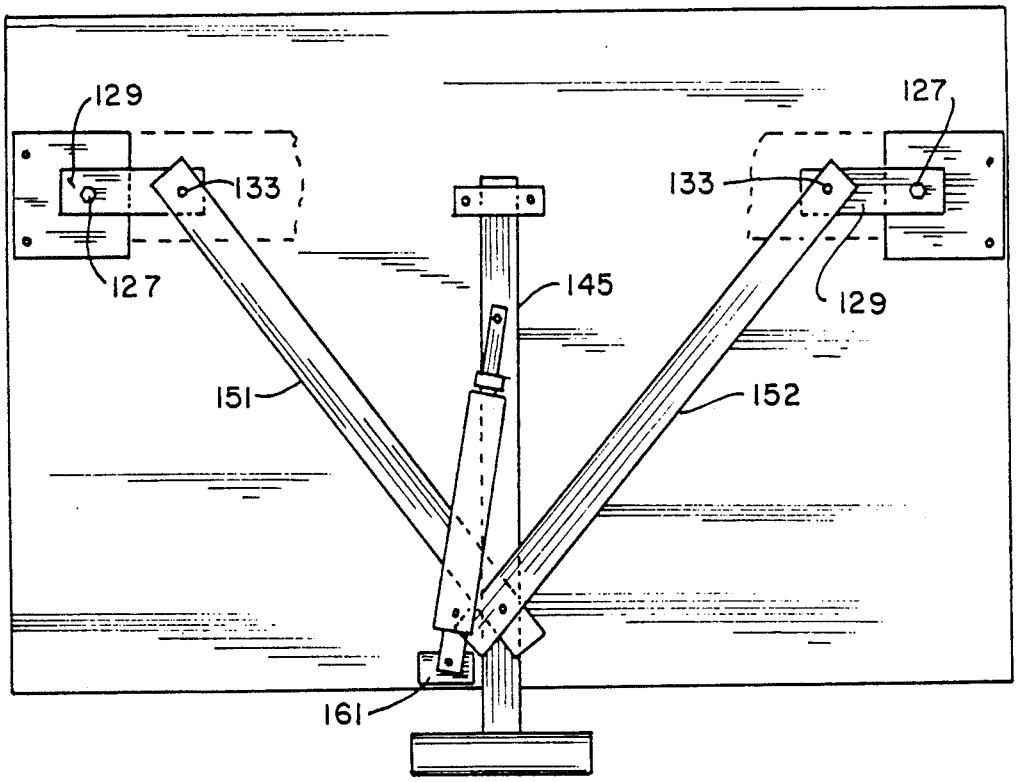
FIG. 6 is a view of a second embodiment of operating mechanism.

Referring now to FIG. 6 for a still further simplified version of window means operating mechanism, which still can be operated from the center of the window sill, an operator shaft 145 is journaled in suitable bearings for linear motion. The shaft projects from the sill housing, and is provided with a bump roll, just as the operator of the first embodiment is. In this embodiment, two push rod levers 151 and 152 are provided, both pivoted at one end to the operator shaft 145, and at their other ends, to crank pins 133 of cranks 129 secured to window member pivot pins 127. In this embodiment, a return spring mechanism 160 is connected at one end to a mounting bracket 161 carried by the sill housing, and at its other end, to the operator shaft 145 itself.

The operation of the mechanism of this embodiment will be self-evident from the description of the first embodiment.

Numerous variations in the construction of the window and its operating mechanism, within the scope of the appended claims, will occur to those skilled in the art in the light of the foregoing disclosure.

Merely by way of example, the channel members carried by the operating bar can take the form of nylon or other plastic bosses, either set into openings in the plate or surface mounted. The operating shaft can be made telescopic between the bump roll and lever pivot point, and equipped with a compression spring to absorb shock and preclude damage to the mechanism. These are merely illustrative.

Having thus described the invention, what is claimed and desired to be secured by Letters Patent is:

1. In a serving window having a pair of center opening swinging window members each mounted on a vertical shaft projecting downwardly from its respective window member, a frame receiving said members, said frame including a sill housing beneath said member, into which said shafts extend, and an operating mechanism in said housing for opening and closing said window member including a crank arm secured to each of said shafts, the improvement comprising a crank pin extending downwardly from each of said crank arms, an elongated bar, extending between the said crank pins, mounted intermediate its ends on pivot means and carrying channel means into which said crank pins extend, and operator means for rocking said bar about said pivot means whereby the crank pins, hence said crank arms, shafts and windows are rotated by said channel means between window member opened and window member closed positions.

2. The improvement of claim 1 including means for biasing said bar to a position at which said window members are closed.

3. The improvement of claim 1, wherein the channel means are arcuate, lie generally in the direction of a long axis of said bar, and are concave along surfaces against which said crank pins bear in moving from window closed to window opened position, and convex along surfaces against which said crank pins bear in moving from window opened to window closed position

4. The improvement of claim 3 wherein the channel means are defined by edges defining openings in the said bar itself.

5. The improvement of claim 1 wherein said operator means includes a shaft movable substantially perpendicularly to the plane of the window members in their closed position and located substantially midway of the sill housing between the window members, and a link pivoted to said shaft at one end and at another end to said bar.

6. The improvement of claim 5 wherein said shaft projects outside said sill housing on the inside of said doors and a bump pad is mounted on the projecting end of said shaft substantially in the center of the span between the outer edges of said doors.

7. The improvement of claim 5 wherein said bar is pivoted asymmetrically of its length, more remote from the end to which said link is pivoted than from the other end of said bar.

8. The improvement of claim 7 including a guide block mounted on said bar between said bar pivot means and the place at which said link is pivoted to said bar and said shaft is slidably mounted in said guide block.

* * * * *